United States Patent [19]

Sone et al.

[11] Patent Number: 4,468,543

[45] Date of Patent: Aug. 28, 1984

[54] IGNITION DISTRIBUTOR

[75] Inventors: Masazumi Sone; Yukitsugu Hirota, both of Yokohama; Takao Miyashita, Mito; Tatsuo Igawa, Kitaibaragi, all of Japan

[73] Assignees: Nissan Motor Company, Limited, Kanagawa; Hitachi, Ltd., Tokyo, both of Japan

[21] Appl. No.: 361,810

[22] Filed: Mar. 25, 1982

Related U.S. Application Data

[63] Continuation of Ser. No. 100,111, Dec. 4, 1979, abandoned.

[30] Foreign Application Priority Data

Dec. 11, 1978 [JP] Japan ..... 53-152029
Dec. 11, 1978 [JP] Japan ..... 53-152032

[51] Int. Cl.[3] ..... F02P 7/02; H01H 19/00

[52] U.S. Cl. ..... 200/19 DR; 123/146.5 A; 123/633; 200/19 R; 200/264

[58] Field of Search ..... 123/146.5 A, 633; 200/19 R, 19 DC, 19 DR, 264

[56] References Cited

U.S. PATENT DOCUMENTS 4,007,342 2/1977 Makino et al. ..... 123/146.5 A
4,135,066 1/1979 Yamanaka et al. ..... 123/146.5 A
4,345,120 8/1982 Sawada et al. ..... 200/19 DC

FOREIGN PATENT DOCUMENTS 546953 3/1977 U.S.S.R. ..... 200/264

*Primary Examiner*—Parshotam S. Lall
*Assistant Examiner*—W. R. Wolfe

[57] ABSTRACT

An ignition distributor is disclosed for use in an internal combustion engine including a plurality of cylinders each fitted with an ignition plug. The distributor includes a plurality of fixed electrodes disposed in circumferential spaced relationship and electrically connected to the respective ignition plugs. A rotor electrode is provided which is electrically connected to a power source and rotatable to successively face the fixed electrodes with a narrow gap with rotation of the engine thereby distributing power to the respective ignition plugs. At least either of the rotor electrode and each of the fixed electrodes has its facing surface formed of conductive and insulating materials combined.

5 Claims, 9 Drawing Figures

IGNITION DISTRIBUTOR

This is a continuation of application Ser. No. 100,111, filed Dec. 4, 1979, now abandoned.

BACKGROUND OF THE INVENTION

1Field of the Invention

This invention relates to an ignition distributor for use in a spark ignition type internal combustion engine and, more particularly, to a low-noise ignition distributor capable of suppressing noise due to spark discharge occurring between its rotor and fixed side electrodes.

2. Description of the Prior Art

Noise attendant on spark discharge occurring in the ignition system of an internal combustion engine creates disturbances in broadcasting systems such as televisions and radios and troubles in electronic controlled systems such as an electronic controlled fuel injection system, electronic controlled antiskid system, and electronic controlled automatic transmission system, and the like to endanger safe traffic. Thus, it had been desired to suppress such noise as low as possible.

Such noise is caused mainly by (1) spark discharge occurring between ignition plug electrodes, (2) spark discharge occurring between ignition distributor rotor and fixed side electrodes, and (3) spark discharge occurring between ignition distributor braker contacts. Although several attempts have been made in order to suppress noise resulting from spark discharge enumerated in item (2), they have been found to be insufficient in the following respects:

(A) A rotor electrode with resistive material embedded therein has its noise suppressing effect limited for high frequencies more than 200 MHz due to the presence of distributed capacitance paralleled with the resistor although it can suppress noise by 5 to 6 dB for frequencies less than 200 MHz. Additionally, it causes high ignition energy loss due to the presence of the resistive material of several kiloohms.

(B) A rotor electrode with its surface provided with a high resistive material layer demonstrates high ignition energy loss due to the provision of the high resistive material layer on the electrode surface, low noise suppressing effect of 4 to 5 dB, and a tendency of the high resistive material layer to peel off.

(C) A rotor electrode facing a fixed electrode with an increased gap of 1.524 to 6.35 mm exhibits very high ignition loss due to the increased discharge gap although its noise suppressing effect is as high as 15 to 20 dB. Such very high ignition energy loss is contrary to the recent requirements of positive ignition with high ignition energy for high exhaust emission purifying and high fuel economy.

SUMMARY OF THE INVENTION

It is therefore one object of the present invention to provide an improved ignition distributor which is high in noise suppressing effect and less in ignition energy loss.

Another object of the present invention is to provide an improved ignition distributor of the character described which is simple in structure and inexpensive to produce.

According to the present invention, these and other objects are accomplished by an ignition distributor for use in an internal combustion engine including a plurality of cylinders each fitted with an ignition plug, the ignition distributor comprising a plurality of fixed electrodes disposed in circumferential spaced relationship and electrically connected to the respective ignition plugs, a rotor electrode electrically connected to a power source and rotatable to successively face the fixed electrodes with a narrow gap with rotation of the engine thereby distributing power to the respective ignition plugs, and at least either of the rotor electrode and each of the fixed electrodes having its facing surface formed of conductive and insulating materials combined.

The facing surface of at least either of the rotor electrode and each of the fixed electrodes may be formed of a conductive material and formed therein with a plurality of slits filled with an insulating material. Alternatively, a conductive layer impregnated with a liquid insulating material may be disposed on the facing surface of at least either of the rotor electrode and each of the fixed electrodes.

Other objects, means and advantages of the present invention will become apparent to one skilled in the air thereof from the following description.

BRIEF DESCRIPTION OF THE DRAWINGS

FIGS. *7a* and *7b* are perspective views showing alternative embodiments of the present invention.

DESCRIPTION OF THE PREFERRED EMBODIMENTS

Figure 1:
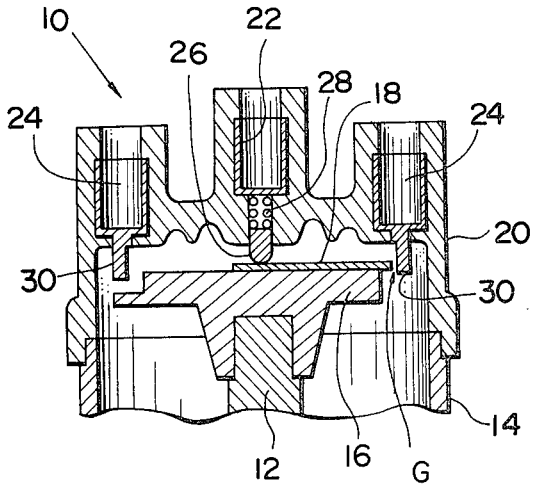
FIG. 1 is a sectional view of an ignition distributor embodying the features of the present invention.

Referring now to FIG. 1, there is illustrated generally at 10 an ignition distributor as incorporated in an internal combustion engine (not shown). In FIG. 1, the reference numeral 12 designates a cam shaft extending within a housing 14 attached to the engine and coupled to the crankshaft (not shown) of the engine for rotation in unison therewith. The ignition distributor 10 comprises an insulating rotor 16 secured at its lower side to the cam shaft 12 and provided on its upper surface with a rotor electrode 18, and a distributor cap 20 secured to the housing 14 and provided with a center input terminal 22 and a plurality of circumferentially spaced side output terminals 24 related to the number of cylinders in the engine. The center input terminal 22 is electrically connected to the rotor electrode 18 through a carbon electrode 26 and a spring 28 urging the carbon electrode 26 into contact with the rotor electrode 18. The side output terminals 24 are electrically connected to side electrodes 30, respectively.

When a high voltage is applied from an ignition coil (not shown) through a high voltage cable (not shown) to the center input terminal 22, it is conducted through the spring 28 and the carbon electrode 26 to the rotor electrode 18. This causes dielectric breakdown of air in a small gap G between the rotor electrode 18 and one side electrode 30. The high voltage is then conducted through a high voltage cable (not shown) to the corresponding one of ignition plugs (not shown).

In such an ignition distributor, the high voltage applied thereto from the ignition coil does not increase to its maximum level in stepped form but expotentially in accordance with the time constant of the circuit including the ignition coil and the high voltage cable. When the high voltage increases to a level sufficient to cause spark discharge in the gap G, abrupt dielectric brakdown of air occurs in the gap G to produce spark discharge therein so as to cause a flow of unstable discharge current having a short pulse width and high peak value to produce a great amount of high frequency components which are spreaded around from the high voltage cable serving as an antenna to have adverse effects on broadcasting systems and electronic controlled systems.

The intensity of the noise field spreaded around a noise source is normally considered to be proportional to such discharge current. Thus, the capacitive discharge current flowing across the gap G between the rotor electrode and the fixed electrode may be reduced to suppress the noise field. As used herein, the term "capacitive discharge current" is intended to mean current caused by a high speed and steeply rising flow of charges stored in the stray capacity between ground and the electrode near the gap G upon dielectric breakdown.

Figure 2:
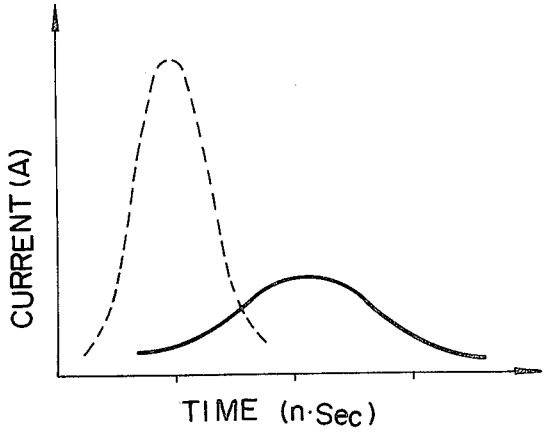
FIG. 2 is a graph showing comparative waveforms of two capacitive discharge currents, one provided by the ignition distributor of the present invention and the other provided by a conventional ignition distributor.

It has been found in our experiments that, if alternatively arranged conductive and insulating materials are disposed on the facing or discharge surface(s) of both or either of the rotor electrode 18 and each of the fixed side electrodes 30, the peak value of the capacitive discharge current can be remarkably reduced as shown in FIG. 2. In FIG. 2, the broken curve relates to a conventional rotor electrode formed of brass, and the solid curve relates to a rotor electrode formed of brass and formed with a plurality of slits filled with an insulating material such as SiO2. It can be seen in FIG. 2 that, with the rotor electrode formed of brass and formed with a plurality of slits pluged with SiO2, the discharge current rises gradually and has a reduced peak value. This permits a considerable reduction of undesirable high frequency components which is a cause of production of a noise field. The reasons of such a change of the waveform of the discharge current are not fully understood, but some general observations may be made. One explanation of the above phenomenon is that spark discharge produces ions, which are stored on the insulator to intensify the electric field around the discharge surface and emit a great number of electrons from the metal of the rotor electrode so as to intensify ionization in the rotor electrode. Such a rotor electrode formed of brass and formed with a plurality of slits filled with an insulating material has been proven effective to considerably reduce the voltage level at which spark discharge starts. This permits a reduction of ignition energy loss due to spark discharge.

Figure 3:
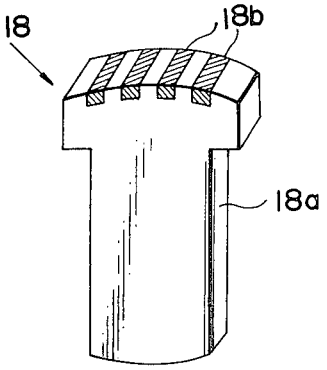
FIG. 3 is a perspective view showing one embodiment of the rotor electrode of the present invention.

FIG. 3 is a perspective view of one embodiment of the rotor electrode made in accordance with the present invention. The rotor electrode 18 comprises an electrode body 18*a* formed of a conductive material and formed in its discharge surface with a plurality of transversely extending and longitudinally spaced slits filled with an insulating material 18*b*.

Figure 4:
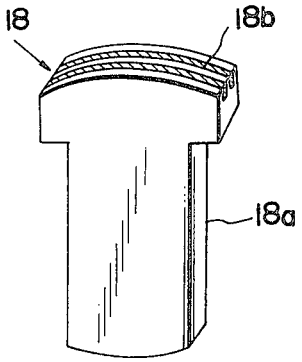
FIGS. 4 to 6 are perspective views showing various modifications of the rotor electrode of FIG. 3.

FIG. 4 is a modification of the rotor electrode embodying the present invention, where the conductive electrode body 18*a* is formed in its discharge surface with a plurality of longitudinally extending and transversely spaced slits filled with an insulating material 18*b*.

Figure 5:
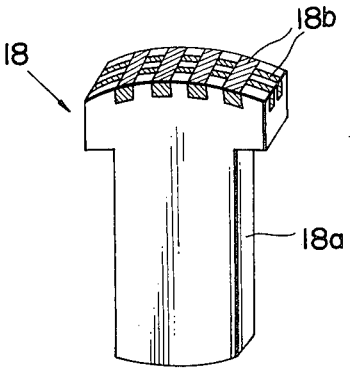

FIG. 5 is another modification of the rotor electrode of the present invention. The discharge surface of the conductive electrode body 18*a* is formed therein with a plurality of transversely extending and longitudinally spaced slits and a plurality of longitudinally extending and transversely spaced slits crossing the former slits. The slits are filled with an insulating material 18*c*.

Figure 6:
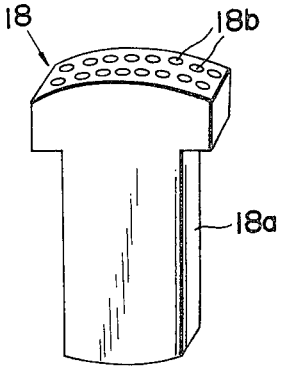

FIG. 6 is still another modification of the rotor electrode of the present invention. The rotor electrode 18 comprises an electrode body 18*a* formed of a conductive material and having on its discharge surface a plurality of insulators 18*b* bonded thereon in studded form. The discharge surface of the conductive electrode body 18*a* may be coated with silicone vanish in dotted form.

In the above described rotor electrodes, examples of the conductive material include, but are in no way limited to, metals such as copper, brass, aluminium, and the like, and ferrite. The insulating material may be SiO3, Al2O3, ceramics, or the like. With such a rotor electrode 18 having its conductive electrode body 18*a* formed of metal such as copper, brass, or the like, its noise suppressing effect is improved by 15 to 20 dB as compared with conventional rotor electrodes formed of brass. A further 10 dB noise reduction is achieved with the rotor electrode having its conductive electrode body 18*a* formed of ferrite. It is to be noted, of course, that such alternatively arranged conductive and insulating materials may be disposed on the fixed side electrodes 30 or both of the rotor electrode 18 and the fixed side electrodes 30.

It has also been found in our experiments that, if a layer formed of a conductive material and impregnated with a liquid insulating material is disposed on the facing or discharge surface(s) of both or either of the rotor electrode 18 and each of the fixed side electrodes 30, the peak value of the capacitive discharge current can be remarkably reduced. Such a rotor electrode provided on its discharge surface with a conductive layer impregnated with a liquid insulating material has been proven effective to remarkably reduce the voltage level at which spark discharge starts. This permits a reduction of ignition energy loss due to spark discharge.

Figure 7A:
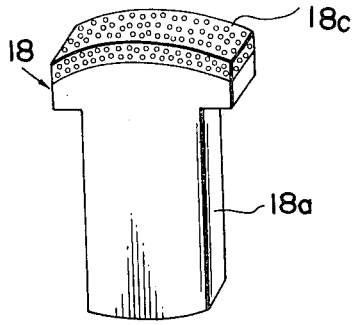
Figure 7B:
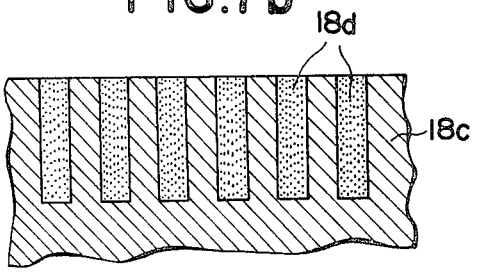

FIGS. 7*a* and 7*b* illustrate an alternative embodiment of the rotor electrode of the present invention. The rotor electrode 18 comprises an electrode body 18*a* formed of a conductive material such as copper, brass, aluminium, or the like, a porous metal layer 18*c* disposed on the discharge surface of the electrode body 18*a*, and the porous layer impregnated with a liquid insulating material 18*d* such as silicone oil, silicone grease, or the like. For example, the porous metal layer 18*c* may be made by sintering copper powder at high temperature. Instead of the porous metal layer, ferrite may be used which is not porous but can be impregnated with a liquid insulating material. A further 10 dB noise reduction is achieved with a rotor electrode having a ferrite layer disposed on its discharge surface as compared with a rotor electrode having a porous layer.

If the porous metal or ferrite layer is impregnated with a silicone oil and then heated at high temperature, the silicone oil is changed into chemically stable SiO2. It is to be noted, of course, that the metal or ferrite layer impregnated with a liquid insulating material may be disposed on the discharge surface(s) of both or either of the rotor electrode and the fixed side electrodes. If desired for convenience of rotor electrode production, the rotor electrode 18 itself may be formed of metal or ferrite impregnated with a liquid insulating material.

Figure 8:
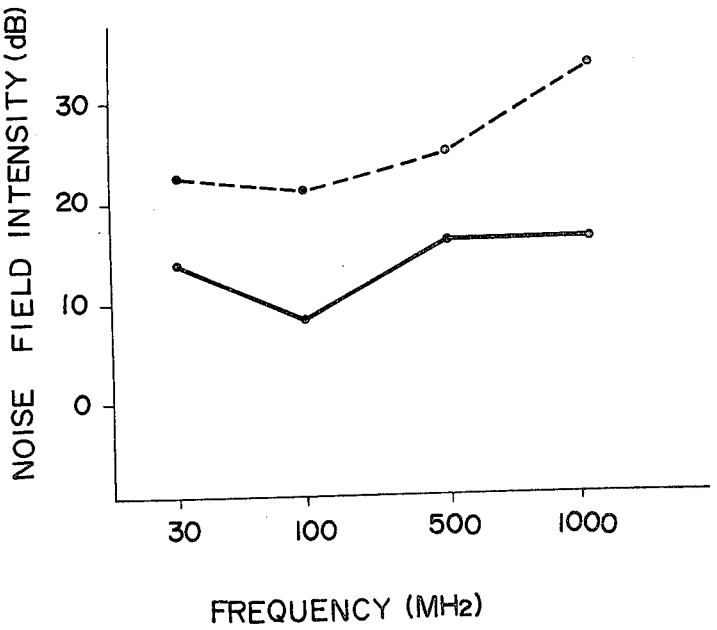
FIG. 8 is a graph showing comparative noise field intensities, one provided by the ignition distributor of the present invention and the other provided by a conventional ignition distributor.

FIG. 8 is a graph showing comparative noise field intensities with respect to given frequencies, where 1 mV/m is expressed as 0 dB when a 1800 cc engine runs at 1500 rpm. The broken curve is provided by a conventional ignition distributor and the solid curve is provided by the ignition distributor of the present invention. It can be seen in FIG. 8 that the present invention attains an about 10 dB noise reduction improvement over the full range of frequencies.

There has been provided, in accordance with the present invention, an improved ignition distributor which is high in noise suppressing effect and low in ignition energy loss and which is simple in structure and inexpensive to produce. While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A distributor for use in an internal combustion engine including a plurality of cylinders, and spark plugs associated with said respective cylinders, comprising:

(a) stationary electrodes formed of a conductive material and disposed in circumferential spaced relationship, said stationary electrodes electrically connected to said respective spark plugs;

(b) a rotor electrode formed of a conductive material and electrically connected to a power source, said rotor electrode being rotatable to bring its end surface to positions facing said stationary electrodes successively with a narrow gap as said engine rotates, the end surface of said rotor electrode comprising a material capable of being impregnated with a liquid insulator and being so impregnated to form a plurality of finite insulated surfaces and conductive surfaces separately disposed from one another.

2. A distributor according to claim 1, wherein said conductive material is formed of a porous metal.

3. A distributor according to claim 1, wherein said liquid insulator is silicone oil.

4. A distributor according to claim 1, wherein said liquid insulator is silicone grease.

5. A distributor according to claim 1, wherein said conductive material is ferrite.

* * * * *